United States Patent [19]

Harbin et al.

[11] Patent Number: 4,841,588

[45] Date of Patent: Jun. 27, 1989

[54] BLANKET WITH HEAD AND FOOT RETAINING POCKETS

[76] Inventors: Keith E. Harbin; Deborah A. Harbin, both of 8107 Sorrento, Detroit, Mich. 48228

[21] Appl. No.: 282,696

[22] Filed: Dec. 12, 1988

[51] Int. Cl.[4] ..... A47G 9/04

[52] U.S. Cl. ..... 5/494; 5/497; 5/502

[58] Field of Search ..... 5/494–499, 5/502

[56] References Cited

U.S. PATENT DOCUMENTS

| | | | |
|---|---|---|---|
| 1,267,593 | 5/1918 | Roever | 5/499 |
| 1,726,224 | 8/1925 | Handl | 5/494 |
| 2,641,001 | 6/1953 | Krasnov | 5/499 |
| 2,789,292 | 4/1957 | Budinquest | 5/494 X |
| 4,386,439 | 6/1983 | Roccograndi et al. | 5/502 X |
| 4,402,098 | 9/1983 | McClam | 5/502 X |
| 4,546,508 | 10/1985 | Ison | 5/502 X |

*Primary Examiner*—Alexander Grosz
*Assistant Examiner*—Michael F. Trettel
*Attorney, Agent, or Firm*—Brooks & Kushman

[57] ABSTRACT

An easy to make blanket for a bed having a head pocket portion and a foot packet portion enveloping the head and foot portions of a mattress. The head pocket includes an upper panel and a lower panel interconnected by a side panel portion having a head and two sides disposed perpendicularly to the head panel. The foot pocket includes an upper panel and lower panel interconnected by a side panel portion having a foot panel and two side panels disposed perpendicular to the foot panel portion. The side panels of the head and foot pockets are interconnected by side extension panels. An elastic segment interconnects the side panel extensions to the head pocket side panels. The elastic portions are preferably concealed from view when the blanket is installed on the mattress. An openable cover portion is preferably formed as an extension from the top panel of the foot pocket. The openable cover includes right and left side tuck flaps which are tucked between the side extensions and the mattress to make the bed quickly and easily. A detachable sheet may be provided that is fastened about its peripheral edges to the inside of the openable cover, the top panel of the foot pocket, and the tuck flaps.

10 Claims, 3 Drawing Sheets

BLANKET WITH HEAD AND FOOT RETAINING POCKETS

TECHNICAL FIELD

The present invention relates to a blanket which is installed upon the head and foot portions of a mattress and includes an openable cover. The openable cover includes side flaps which are tucked between the mattress and side extension panels of the blanket to simplify making a bed.

BACKGROUND OF THE INVENTION

Bed clothing consisting of a fitted element and a partially attached top layer are disclosed in the prior art including U.S. Pat. No. 1,865,329 to Horter, U.S. Pat. No. 2,525,713 to North, U.S. Pat. No. 3,962,739 to Crockett and U.S. Pat. No. 4,266,308 to Shatz. These are rather difficult to install on a bed or are easily dislodged from the mattress.

Fitted bed clothing including elastic strips which allow the bed clothes to resiliently encompass a mattress have been disclosed in U.S. Pat. No. 3,013,283 to Steffinich and U.S. Pat. No. 4,672,902 to Isham. In Steffinich, the elastic panel is sewn to the corner of the sheet and is easily dislodged. In Isham, stretch fit ends are sewn to the entire head and foot portions of the bed clothing which adds significantly to the cost of the bed clothing assembly. Further, the patent to Isham while it discloses an openable cover portion in FIG. 4, fails to disclose a blanket which is easy to make and provides a clean, attractive bed when made.

These and other problems and disadvantages of prior art bed clothing devices are addressed and solved by the improved blanket of the present invention.

SUMMARY OF THE INVENTION

The present invention relates to a blanket for a bed having a mattress. The blanket includes a head pocket having a top panel, a bottom panel and a side panel which interconnects the top and bottom panels on a head edge and right and left side edges. The head pocket fits over the head end of the mattress with the right and left side edges of the side panel extending toward the foot end of the mattress. The blanket has a foot pocket having a top panel, a bottom panel and side panels interconnecting the top panel and bottom panel on a foot edge. The right and left side edges of the side panel extend on right and left sides of the mattress toward the head end of the mattress. Side extension panels interconnect the head pocket and foot pocket on the right and the left sides respectively. The side extension panels each include an elastic strip extending transversely completely across the side extension panel. An openable cover panel is formed as an extension of the top panel of the foot pocket. Right and left tuck flaps extend from the right and left edges of the cover panel between the head pocket and the foot pocket. The tuck flaps are adapted to be inserted between the right and left side extension panels and right and left sides of the mattress.

The top and bottom pockets securely hold the blanket in place on the mattress and effectively prevent shifting of the blanket when the person moves about during sleep. The openable cover spans the top of the mattress and functions substantially the same as a normal blanket. Short elastic strip is provided on each side panel to allow the head pocket to be stretched onto the head portion of the mattress after the foot pocket is fitted over the foot of the mattress. The elastic strips are advantageously located at an intermediate point on the sides of the mattress as opposed to being located at the corners. When expansion, or elastic panels, are placed at the corners of a fitted sheet or blanket, the blanket is more easily dislodged from the mattress. The elastic strip is preferably secured to the head pocket and the end of the side panels closest to the head pocket to make it easier to slip the head pocket over the head and under the mattress.

The side tuck flaps are tucked between the mattress and the side panels so that the bed may be easily made by merely tucking the tuck flaps inside the side panels to make the bed.

The elastic strips are preferably connected to the two side extension panels at the end of the extension panels closest to the head portion. Each elastic strip is also connected to one of the side edges of the head pocket side panel. The elastic strips are sewn to the side extension panels and the head pocket side panel side edges and constitute the sole interconnection between the side extension panels and the head pocket.

The elastic strips are connected to the side extension panels and head pocket so as to be substantially concealed by the side extension panels and head pocket side panel side edges when the blanket is installed on a mattress. The foot pocket and head pocket securely hold the blanket to the mattress and cannot be dislodged by normal movements of a person in bed. The head and foot pockets each define cup-shaped receptacles for their respective ends of the mattress which securely engage the blanket.

The foot pocket may be formed by a pair of bottom panels which are attached on one edge to the right and left side faces of the foot pocket. For larger queen or king size beds, the pair of bottom panels make it easier to place the foot pocket on the mattress and provide sufficient anchoring of the foot pocket. If the foot pocket is made in accordance with this alternative embodiment, the head pocket is first slipped on the head end of the mattress and the foot pocket is then stretched over the foot end with the pair of bottom panels being subsequently tucked under the mattress.

Another feature of the invention is the concept of providing a detachable sheet which is secured at its periphery inside the blanket with fasteners. Mating fasteners are provided on the inside of the top panel of the foot pocket, the inside of the openable cover, and the inside of the tuck flaps.

Other advantages and features of the present invention will become readily apparent upon study of the attached drawings in view of the following detailed description.

DETAILED DESCRIPTION

Figure 1:
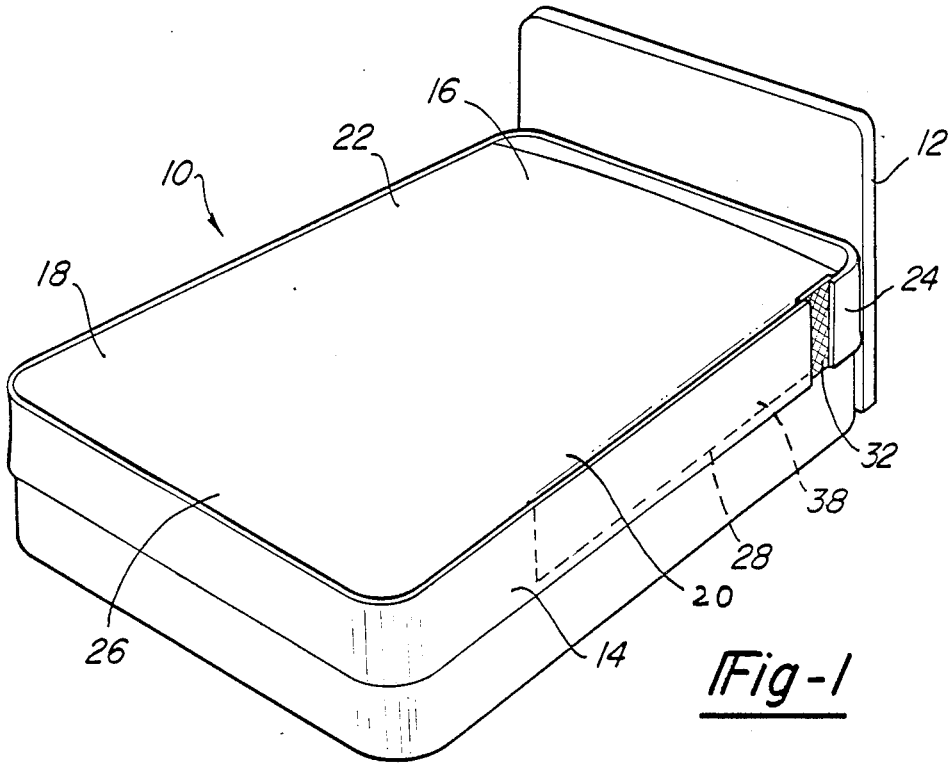
FIG. 1 is a perspective view of a bed having the blanket of the present invention.

Referring now to FIG. 1, the blanket 10 of the present invention is shown as installed on a bed 12 having a mattress 14.

For reference purposes, the mattress will be referred to as having a head end 16, a foot end 18 and right and left sides 20 and 22. The blanket includes a head pocket 24 which is disposed over the head end 16 of the mattress 14. A foot pocket 26 is disposed over the foot end 18 of the mattress 14. The head and foot pockets 24 and 26 are interconnected by a right side extension panel 28 and a left side extension panel 30 on the right and left sides of the bed respectively. The head and foot pockets are resiliently urged to encompass the mattress by right and left elastic panels 32 and 34 which interconnect the head pocket 24 to the right and left side extension panels 28 and 30.

An openable cover 36 is provided as an extension from the foot pocket 26. The cover 36 includes right and left flaps 38 and 39. Right and left tuck flaps 38 and 39 are adapted to be inserted between the right and left side extension panels 28 and 30 and the right and left sides 20 and 22 of the mattress 14.

Figure 2:
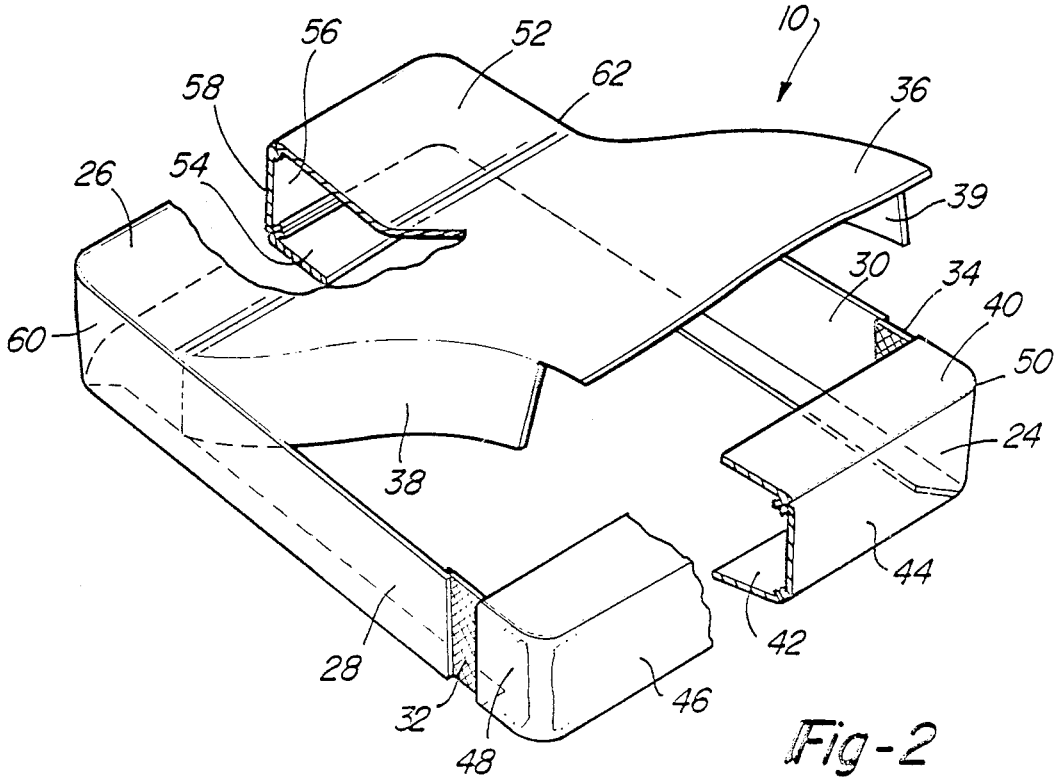
FIG. 2 is a perspective view of the blanket of the present invention partially broken away.
Figure 3:
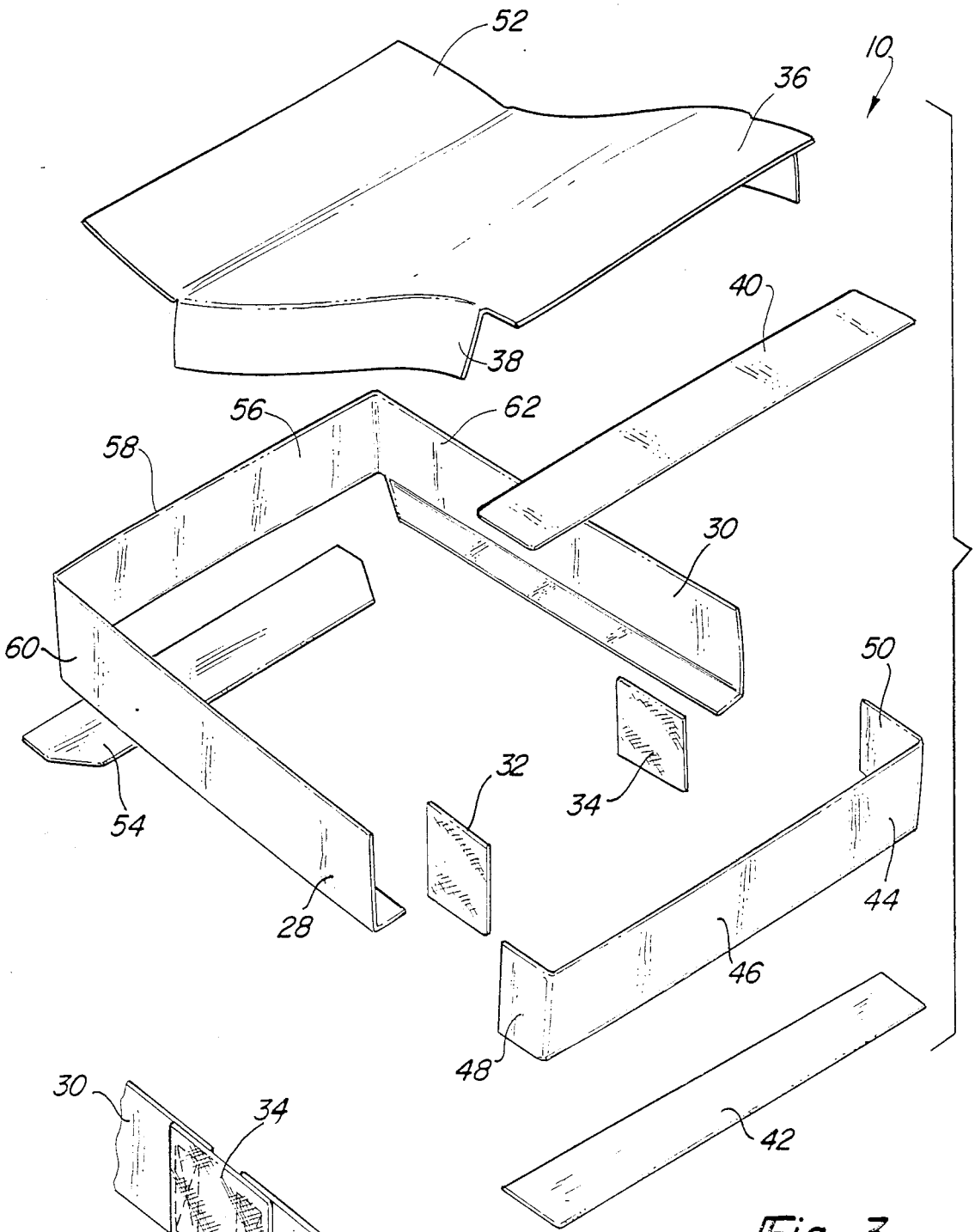
FIG. 3 is an exploded perspective view of the parts of the blanket of the present invention.

Referring now to FIGS. 2 and 3, the construction of the elements of the blanket will be described in greater detail. The head pocket 24 is formed by a top panel 40 and bottom panel 42 which are interconnected by a side panel 44. The side panel 44 includes a head face 46 and right and left side faces 48 and 50. The right and left side faces 48 and 50 extend toward the foot end of the mattress. The foot pocket 26 is formed by a top panel 52 and a bottom panel 54 which are joined on three edges to the side panel 56. The side panel 56 includes a foot face 58 and right and left side faces 60 and 62 which extend from the foot face 58 toward the head 16 and the mattress.

The head and foot pockets may be formed by several different combinations of panels. For instance, the head pocket 24 may be formed from one piece of material and folded to define the top panel 40 and bottom panel 42 with the right side face 48 and left side face 50 formed as extensions from the head face 46. The foot panel can be likewise formed or can be formed by securing the top and bottom panels to an elongated side panel made up of the right and left side extension panels 28 and 30 and the foot face 58. Details regarding the interconnection of the panels to each other can be varied for aesthetic purposes or manufacturing efficiency.

Figure 4:
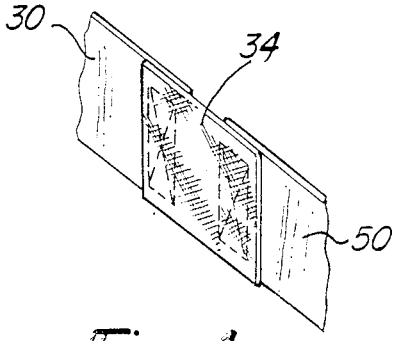
FIG. 4 is a fragmentary section view showing the elastic panel secured to the head pocket and side extension panel according to the present invention.

A unique feature of the present invention is illustrated in FIG. 4 wherein the interconnection between the left side extension panel 34 and the left side face 50 by the left elastic panel 34 is shown. The elastic panel bridges the gap between the left side extension panel 30 and the left side face 50 and is sewn thereto to permit the sides of the blanket to be stretched over the mattress 14.

The foot pocket 26 is preferably of greater depth than the head pocket 24. Therefore, to facilitate attaching the blanket 10 to the mattress 14, the foot pocket is placed over the foot end 18 of the mattress first with the head pocket 24 being then placed over the head end 16 of the mattress 14 by stretching the right and left elastic panels 32 and 34 as required.

Figure 5:
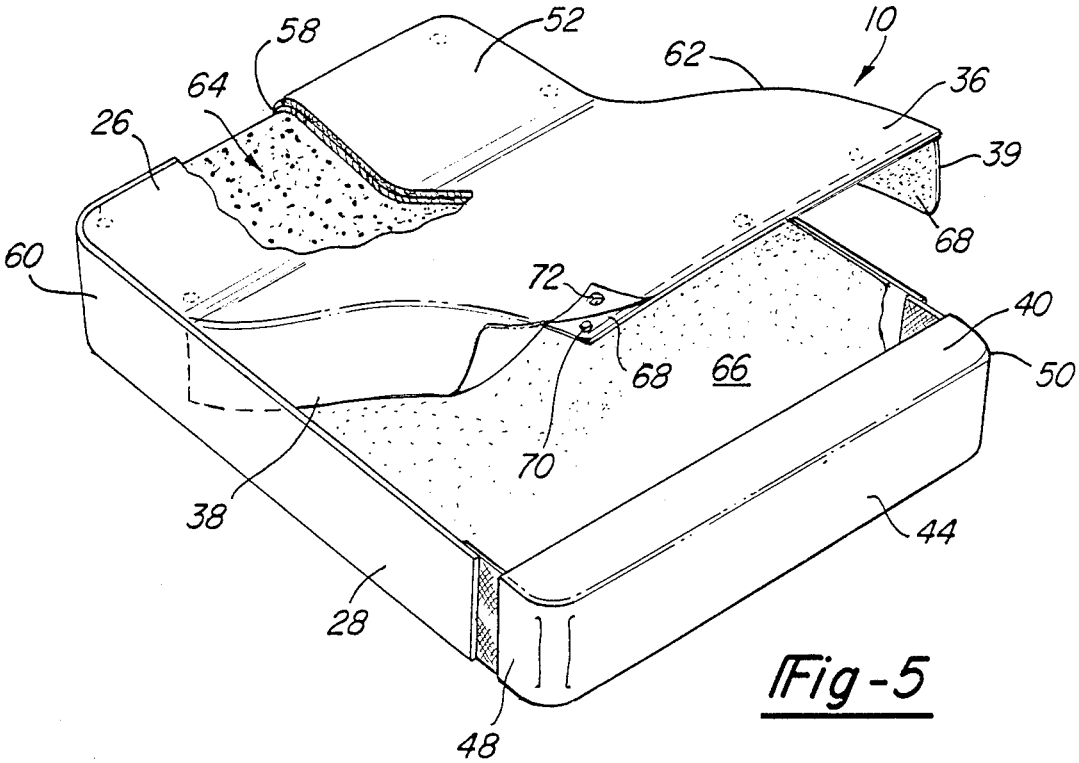
FIG. 5 is a perspective view of the blanket of the present invention and a detachable sheet.

Referring now to FIG. 5, a detachable sheet 64 is shown attached to the blanket 10 of the invention. The detachable sheet preferably includes a contoured bottom sheet 66 to which a top sheet 68 is preferably sewn on an edge located at the foot of the bed. The top sheet incudes peripheral snap fastener elements 70. Corresponding snap fastener elements 72 are affixed to the top panel 52 of the foot pocket 26, the openable cover 36, and the tuck flaps 38 and 39. The detachable sheet 64 may be removed and the bed remade without removing the blanket 10, a feature of this embodiment which is not possible with the prior art.

Figure 6:
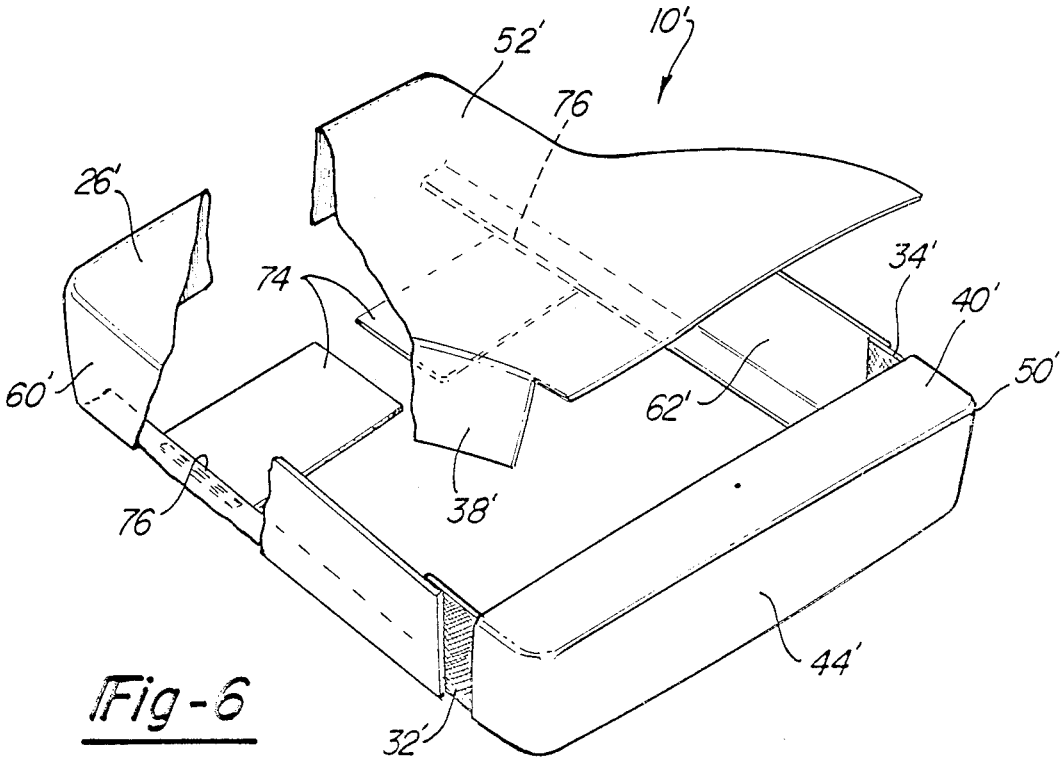
FIG. 6 is a perspective view of an alternative embodiment of the present invention.

Referring now to FIG. 6, an alternative embodiment of the blanket 10′ having a foot pocket 26′ which is better adapted for larger beds is shown. In this embodiment, a pair of rectangular flaps, or bottom panels 74 are respectively secured at one edge 76 to the right and left side faces 60′ and 62′ of the foot pocket 26′. The top panel 52′ of the foot pocket 26′ spans the top of the blanket between the side faces 60′ and 62′. Elastic panels 32′ and 34′ join the side faces 60′ and 62′ to the right and left side faces 49′ and 50′ of the side panel 44′ of the head pocket 24′. The head pocket also includes a top panel 40′ interconnecting the top edges of the side panel 44′. The embodiment of FIG. 6 is specially adapted for larger beds. The blanket 10′ would preferably be installed on the mattress by first fitting the head pocket 24′ over the head end 14 of the mattress then the foot pocket 26′ is structured over the foot end 18 of the mattress with the flaps 74 being tucked under the mattress to hold the foot pocket 26′ in place.

It will be appreciated that many modifications and variations in the invention may be made within the scope of the following claims.

What is claimed is:

1. A blanket for a bed including a mattress having a head end, a foot end, a right side, and a left side comprising:

a head pocket having a top panel, a bottom panel, and a side panel connected to the top panel and the bottom panel, said side panel having a head face and a right side face and a left side face, said right and left side faces being disposed at right angles to the head face and extending toward the foot end of the mattress to form side edges on the right side and left side respectively, said heat pocket being adapted to be placed over the head end of the mattress;

a foot pocket having a top panel, a bottom panel, and a side panel connected to the top panel and the bottom panel, said side panel having a foot face and a right side face and a left side face, said right and left side faces being disposed at right angles to the foot face and extending toward the head end of the mattress on the right side and left side respectively, said foot pocket being adapted to be placed over the foot end of the mattress;

a right side extension panel and a left side extension panel extending from the right side face and left side face of the head pocket and the right side face and left side face of the foot pocket on right and left sides of the mattress, said right and left side extension panels each including an elastic strip extending transversely across a gap formed between the side extension panel and the right and left side faces of the head pocket;

an openable cover panel formed as an extension of the top panel of the foot pocket, said cover having a right edge and left edge; and a right tuck flap and a left tuck flap extending from the right edge and the left edge of the cover panel between the head pocket and foot pocket, said tuck flaps being insertable between the right and left side extension panels and the right and left sides of the mattress.

2. The blanket of claim 1 wherein the elastic strips are connected to the two side extension panels at an end closest to the head portion and each elastic strip is respectively connected to one of the side edges of the head pocket side panel.

3. The blanket of claim 2 wherein the elastic strips are sewn to the side extension panels and the head pocket side panel side edges constituting the sole interconnection therebetween.

4. The blanket of claim 3 wherein the elastic strips are substantially concealed by the side extension panels and the head pocket side panel side edges when the blanket is installed on the mattress.

5. In the blanket of claim 1, a detachable bed sheet having first fastener elements disposed about the periphery of the bed sheet and second fastener elements disposed on the top panel of the foot pocket, and on the openable cover in locations corresponding to the location of the first fastener elements.

6. A blanket for a bed including a mattress having a head end, a foot end, a right side, and a left side comprising:

a head pocket having a top panel, a bottom panel, and a side panel connected to the top panel and the bottom panel, said side panel having a head face and a right side face and a left side face, said right and left side faces being disposed at right angles to the head face and extending toward the foot end of the mattress to form side edges on the right side and left side respectively, said head pocket being adapted to be placed over the head end of the mattress;

a foot pocket having a top panel, a pair of bottom panels, and a side panel connected to the top panel, said side panel having a foot face and a right side face and a left side face, said right and left side faces being attached to one edge of each of the bottom panels, said right and left side faces being disposed at right angles to the foot face and extending toward the head end of the mattress on the right side and left side respectively, said top panel being adapted to be placed over the foot end of the mattress with the bottom panels tucked under the mattress;

a right side extension panel and a left side extension panel extending from the right side face and left side face of the head pocket and the right side face and left side face of the foot pocket on right and left sides of the mattress, said right and left side extension panels each including an elastic strip extending transversely across a gap formed between the side extension panel and the right and left side faces of the head pocket;

an openable cover panel formed as an extension of the top panel of the foot pocket, said cover having a right edge and a left edge; and a right tuck flap and a left tuck flap extending from the right edge and the left edge of the cover panel between the head pocket and foot pocket, said tuck flaps being insertable between the right and left side extension panels and the right and left sides of the mattress.

7. The blanket of claim 6 wherein the elastic strips are connected to the two side extension panels at an end closest to the head portion and each elastic strips is respectively connected to one of the side edges of the head pocket side panel.

8. The blanket of claim 7 wherein the elastic strips are sewn to the side extension panels and the head pocket side panel side edges constituting the sole interconnection therebetween.

9. The blanket of claim 8 wherein the elastic strips are substantially concealed by the side extension panels and the head pocket side panel side edges when the blanket is installed on the mattress.

10. In the blanket of claim 6, a detachable bed sheet having first fastener elements disposed about the periphery of the bed sheet and second fastener elements disposed on the top panel of the foot pocket, on right and left tuck flaps, and on the openable cover in locations corresponding to the location of the first fastener elements.

* * * * *